US007717069B2

(12) United States Patent
Mokire et al.

(10) Patent No.: US 7,717,069 B2
(45) Date of Patent: May 18, 2010

(54) ENGINE COOLING SYSTEM HAVING TWO COOLING CIRCUITS

(75) Inventors: Mahesh K. Mokire, Peoria, IL (US); Jiubo Ma, Qingdao Shan Dong (CN)

(73) Assignee: Caterpillar Inc., Peoria, IL (US)

( * ) Notice: Subject to any disclaimer, the term of this patent is extended or adjusted under 35 U.S.C. 154(b) by 127 days.

(21) Appl. No.: 11/941,070

(22) Filed: Nov. 15, 2007

(65) Prior Publication Data

US 2009/0126657 A1 May 21, 2009

(51) Int. Cl.
*F01P 1/06* (2006.01)
*F02B 33/10* (2006.01)

(52) U.S. Cl. ..... 123/41.31; 123/563; 60/599

(58) Field of Classification Search ..... 123/41.31, 123/41.33, 41.44, 41.29, 559.1, 563, 196 AB; 60/599; 165/51
See application file for complete search history.

(56) References Cited

U.S. PATENT DOCUMENTS 3,134,371 A * 5/1964 Crooks ..... 123/41.31
3,752,132 A 8/1973 Bentz et al.
4,061,187 A 12/1977 Rajasekaran et al.
4,180,032 A 12/1979 Plegat
4,317,439 A * 3/1982 Emmerling ..... 123/563
4,348,991 A 9/1982 Stang et al.
4,413,596 A 11/1983 Hirayama
4,520,767 A 6/1985 Roettgen et al.
4,550,692 A 11/1985 Crofts, Sr.
4,620,509 A 11/1986 Crofts
5,215,044 A 6/1993 Banzhaf et al.
5,353,757 A 10/1994 Susa et al.
5,394,854 A 3/1995 Edmaier et al.
5,408,843 A 4/1995 Lukas et al.
5,415,147 A 5/1995 Nagle et al.
5,497,734 A 3/1996 Okada
5,669,338 A 9/1997 Pribble et al.
5,715,777 A 2/1998 Wada et al.
5,769,038 A 6/1998 Takahashi et al.
5,910,099 A 6/1999 Jordan, Jr. et al.
6,098,576 A 8/2000 Nowak, Jr. et al.
6,145,480 A 11/2000 Betz et al.
6,244,256 B1 6/2001 Wall et al.
6,340,006 B1 1/2002 Malatto et al.
6,457,442 B1 10/2002 Fuchs et al.
6,530,347 B2 3/2003 Takahashi et al.
6,609,484 B2 8/2003 Penn et al.
6,758,266 B1 7/2004 Sjunnesson et al.
6,830,016 B2 12/2004 Kim
6,945,200 B2 9/2005 Bergstrom et al.
7,047,913 B2 5/2006 Werner et al.
7,128,025 B1 * 10/2006 Westhoff et al. ..... 123/41.01
7,131,403 B1 11/2006 Banga et al.
7,140,330 B2 11/2006 Rogers et al.
7,168,398 B2 1/2007 Ap et al.
7,254,947 B2 8/2007 Burk et al.
7,261,068 B1 8/2007 Wantschik
2003/0033993 A1 * 2/2003 Valaszkai et al. ..... 123/41.31
2005/0133207 A1 6/2005 Schoville et al.
2006/0180103 A1 8/2006 Gruia

* cited by examiner

*Primary Examiner*—Noah Kamen
(74) *Attorney, Agent, or Firm*—Liell & McNeil

(57) ABSTRACT

The present disclosure provides an engine cooling system comprising a first cooling circuit and a second cooling circuit, each of which includes a cooling unit for cooling a compressed or charge air from one or more turbochargers of the engine.

17 Claims, 3 Drawing Sheets

ENGINE COOLING SYSTEM HAVING TWO COOLING CIRCUITS

TECHNICAL FIELD

This disclosure relates, generally, to engine cooling systems and methods, and more particularly, to an engine cooling system having two cooling circuits and the related methods.

BACKGROUND

Internal combustion engines used to operate motor vehicles or heavy mechanical equipment generate considerable heat that must be dissipated. If not properly dissipated, heat reduces operating efficiency of the engine and can ultimately lead to damage of the engine.

Engine cooling systems typically flow a cooling fluid through the block of the engine to cool the engine. The cooling fluid captures heat from the engine and releases the heat through a heat exchanger in which the cooling fluid passes in heat exchange relationship with air or liquid. An air-to-liquid heat exchanger may include a series of tubes through which the cooling fluid is pumped, and airflow induced by a fan cools the tubes, and hence the cooling fluid flowing through the tubes. The cooling fluid can be pumped through various engine components, such as the engine head and block, an engine oil cooler or the like, to remove heat from the various engine components.

In the operation of an internal combustion engine, the amount of combustion air that can be delivered to the intake manifold of the engine, for combustion in the engine cylinders, is a limiting factor in the performance of the engine. Atmospheric pressure is often inadequate to supply the required amount of air for proper and efficient operation of an engine.

Thus, an engine may include one or more turbochargers for compressing air to be supplied to one or more combustion chambers within corresponding combustion cylinders. The turbocharger supplies combustion air at a higher pressure and higher density than existing atmospheric pressure and ambient density. The use of a turbocharger can compensate for lack of power due to altitude, or to increase the power that can be obtained from an engine of a given displacement, thereby reducing the cost, weight and size of an engine required for a given power output. The turbocharger typically includes a turbine driven by exhaust gases from the engine, and one or more compressors driven by the turbine through a turbocharger shaft common to both the turbine and the compressor or compressors. A stream of exhaust gases from the engine is conducted from the exhaust manifold to the turbine, and the exhaust gas stream passing through the turbine causes a turbine wheel to rotate. Rotation of the turbine wheel rotates the common shaft interconnecting the turbine wheel and one or more compressor wheels in the compressor section, thereby rotating the compressor wheels. Air to be compressed is received in the compressor section, wherein the air is compressed and supplied to the air intake system of the engine.

The boost air flowing from the compressor or compressors may be conditioned to affect the overall turbocharger performance and/or the engine efficiency. In turbochargers having multiple stage compressors, compressing the air in the first compressor significantly raises the temperature of the air, increasing the power required by the second compressor to achieve a desired pressure boost. To overcome the detrimental effects of the increase in temperature, so called "intercoolers" have been provided in the flow path between the first compressor outlet and the second compressor inlet. Similarly, so called "aftercoolers" have been used after the turbocharger in turbochargers having both single stage and multi-stage compressors. The aftercooler cools the compressed air being supplied to the intake manifold, thereby increasing the oxygen content per unit volume, to better support combustion in the cylinders and decrease engine operating temperatures.

Certain cooling systems use cooling fluid from the engine cooling system to circulate through the aftercooler, providing a heat exchange medium for the compressed air also flowing through the aftercooler. Heat from the compressed air stream is removed by the cooling fluid and absorbed in the heat exchanger. Reducing the temperature of the charge air can reduce engine emissions and increase engine efficiency.

An aftercooler system may also provide a separate cooling fluid circuit from the heat exchanger to the aftercooler, including a separate circuit aftercooler (SCAC) pump for circulating the cooling fluid to the aftercooler. However, the cooling efficiency of such systems has not always met expectations under all operating conditions.

U.S. Pat. No. 6,609,484 describes a cooling system for an internal combustion engine, with a radiator assembly including a first group of radiator cores and a second group of radiator cores. Some cooling fluid cooled in the first group of radiator cores is passed from the radiator assembly to an engine cooling circuit. Another portion of cooling fluid cooled in the first group of radiator cores is passed to the second group of radiator cores, for additional cooling thereof. From the second group of radiator cores, cooling fluid is passed to the separate circuit aftercooler cooling circuit. A turbocharged engine cooling system using a two-pass heat exchanger and a separate circuit aftercooler pump in an aftercooler cooling circuit is also shown in U.S. Pat. No. 6,158,399.

In view of the engine efficiency and emissions reduction benefits obtained from adequate aftercooling of the combustion air, it is desirable to have an improved cooling system that provides adequate aftercooler cooling while maintaining sufficient cooling of various other engine components under various operating conditions.

The present disclosure is directed to addressing one or more needs as set forth above.

SUMMARY OF THE INVENTION

One aspect of the present disclosure provides a cooling system for an internal combustion engine having one or more turbochargers. The cooling system includes a first cooling circuit having a first heat exchanger configured to reduce the temperature of a first cooling fluid flowing through one or more cooling conduits of an engine head and block. The cooling system further includes a first cooling unit in fluid communication with the first heat exchanger. The first cooling unit is configured to receive the first cooling fluid from the one or more cooling conduits of the engine head and block to reduce the temperature of a charge air directed from the one or more turbochargers. The cooling system may also include a second cooling circuit that includes a second cooling unit configured to reduce the temperature of the charge air directed from the first cooling unit. The second cooling circuit may also include a second heat exchanger in fluid communication with the second cooling unit. The compressed or charge air, after the two-stage cooling, may then be directed to an air intake system of the internal combustion engine.

Another aspect of the present disclosure provides an internal combustion engine having one or more turbochargers and a cooling system that includes a first cooling circuit having a first heat exchanger configured to reduce the temperature of a first cooling fluid flowing through one or more cooling conduits of an engine head and block. The cooling system further includes a first cooling unit in fluid communication with the first heat exchanger. The first cooling unit is configured to receive the first cooling fluid from the one or more cooling conduits of the engine head and block to reduce the temperature of a charge air directed from the one or more turbochargers. The cooling system may also include a second cooling circuit that includes a second cooling unit configured to reduce the temperature of the charge air directed from the first cooling unit.

A further aspect of the present disclosure provides a method of cooling a compressed or charge air in an internal combustion engine having one or more turbochargers. The method may include directing the charge air from the one or more turbochargers to a first cooling unit, which is part of a first cooling circuit having a first heat exchanger configured to reduce the temperature of a first cooling fluid flowing through one or more cooling conduits of an engine head and block. The first cooling unit may be in fluid communication with the first heat exchanger and receive the first cooling fluid flowing through the one or more cooling conduits of the engine head and block. The method may further include directing the charge air from the first cooling unit to a second cooling unit, which is part of a second cooling circuit having a second heat exchanger in fluid communication with the second cooling unit. The second cooling circuit may be configured to reduce the temperature of a second cooling fluid flowing through at least one of a plurality of cooling components adapted to cool engine oil, transmission oil, hydraulic oil, and brake oil of the internal combustion engine. The method may also include directing the charge air from the second cooling unit to an air intake system of the internal combustion engine.

DETAILED DESCRIPTION

Figure 1:
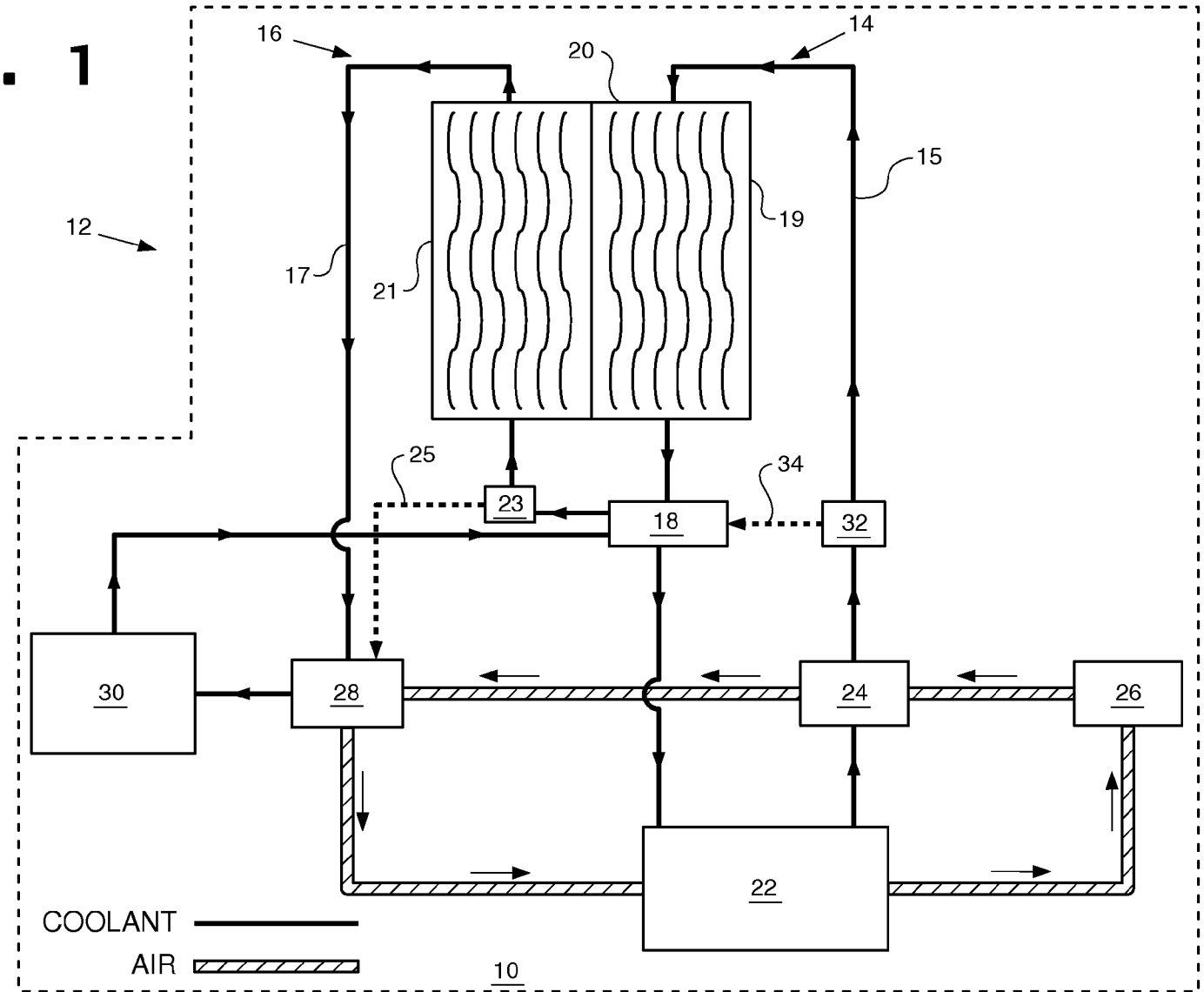
FIG. 1 illustrates an engine cooling system according to one embodiment of the present disclosure that includes one water pump.

Referring now more specifically to FIG. 1, an internal combustion engine cooling system 10 is shown, for and as part of an engine 12. The cooling system 10 includes a first cooling circuit 14 and a second cooling circuit 16. Common to the first cooling circuit 14 and the second cooling circuit 16 is a water pump 18.

In the illustrated embodiment, the radiator assembly 20 is also common to the first cooling circuit 14 and the second cooling circuit 16. The radiator assembly 20 may be a multi-pass jacket water heat exchanger, and as shown, includes a first group of radiator cores or the first heat exchanger 19 and a second group of radiator cores or the second heat exchanger 21. Accordingly, in the illustrated embodiment, the first and second heat exchangers 19 and 21 are part of a multi-pass radiator assembly. In alternative embodiments, the first and second heat exchangers may include separate or independent radiator assemblies or radiator units.

The first cooling circuit 14 further includes the water pump 18, the radiator assembly 20 and more specifically the first heat exchanger 19, the engine head and block 22, and a first cooling unit 24. The water pump 18 can be a jacket water pump and help circulate a first cooling fluid 15 through the first cooling circuit 14. Accordingly, the first cooling circuit 14 provides cooling for the engine head and block 22 by directing the first cooling fluid 15 to flow through one or more cooling conduits embedded therein. Further, the first cooling circuit 14 also provides a first-stage cooling of a compressed or charge air directed from one or more turbochargers (or the turbocharger system) 26 to and through the first cooling unit 24. The first heat exchanger or the first heat exchanger 19 reduces the temperature of the first cooling fluid 15 after it has been circulated through the one or more cooling conduits of the engine head and block 22 and the first cooling unit 24.

The second cooling circuit 16, as shown, also includes the water pump 18, the radiator assembly 20 and more specifically the second heat exchanger 21, a second cooling unit 28, and one or more other cooling components 30. A second cooling fluid 17 is circulated through the second cooling circuit 16, and the second heat exchanger 21 is configured to reduce the temperature of the second cooling fluid 17 after it has been circulated through the second cooling unit 28 and at least one of a plurality of cooling components 30. The one or more other engine cooling components may include an engine oil cooler, a transmission oil cooler, a hydraulic oil cooler, a brake oil cooler, as well as various cooling fluid conduits and valves and sensors (not shown) known in the art. Accordingly, the second cooling circuit 16 provides cooling for one or more other engine components and a second-stage cooling of the compressed or charge air flowing directed from the first cooling unit 24 to and through the second cooling unit 28.

As shown in FIG. 1, a single water pump 18 is common to both the first cooling circuit 14 and the second cooling circuit 16. The use of a single water pump may allow for mixing of the first cooling fluid 15 and the second cooling fluid 17 and therefore heat exchange between the first cooling circuit 14 and the second cooling circuit 16.

Further, the first cooling circuit 14, as shown, may include a temperature sensor and control 32 operably linked to a bypass conduit 34. The temperature sensor and control 32 measures the temperature of the cooling fluid flowing from the first cooling unit 24, and, when the measured temperature is below a first pre-determined threshold temperature, directs the cooling fluid to flow through the bypass conduit 34 to the water pump 18, thereby bypassing the first heat exchanger 19.

The second cooling circuit 16, as shown, may also include a temperature sensor and control 23 operably linked to a bypass conduit 25. The temperature sensor and control 23 measures the temperature of the cooling fluid flowing from the water pump 18, and, when the measured temperature is below a second pre-determined threshold temperature, directs the cooling fluid to flow through the bypass conduit 25 to the second cooling unit 28, thereby bypassing the second heat exchanger 21.

Figure 2:
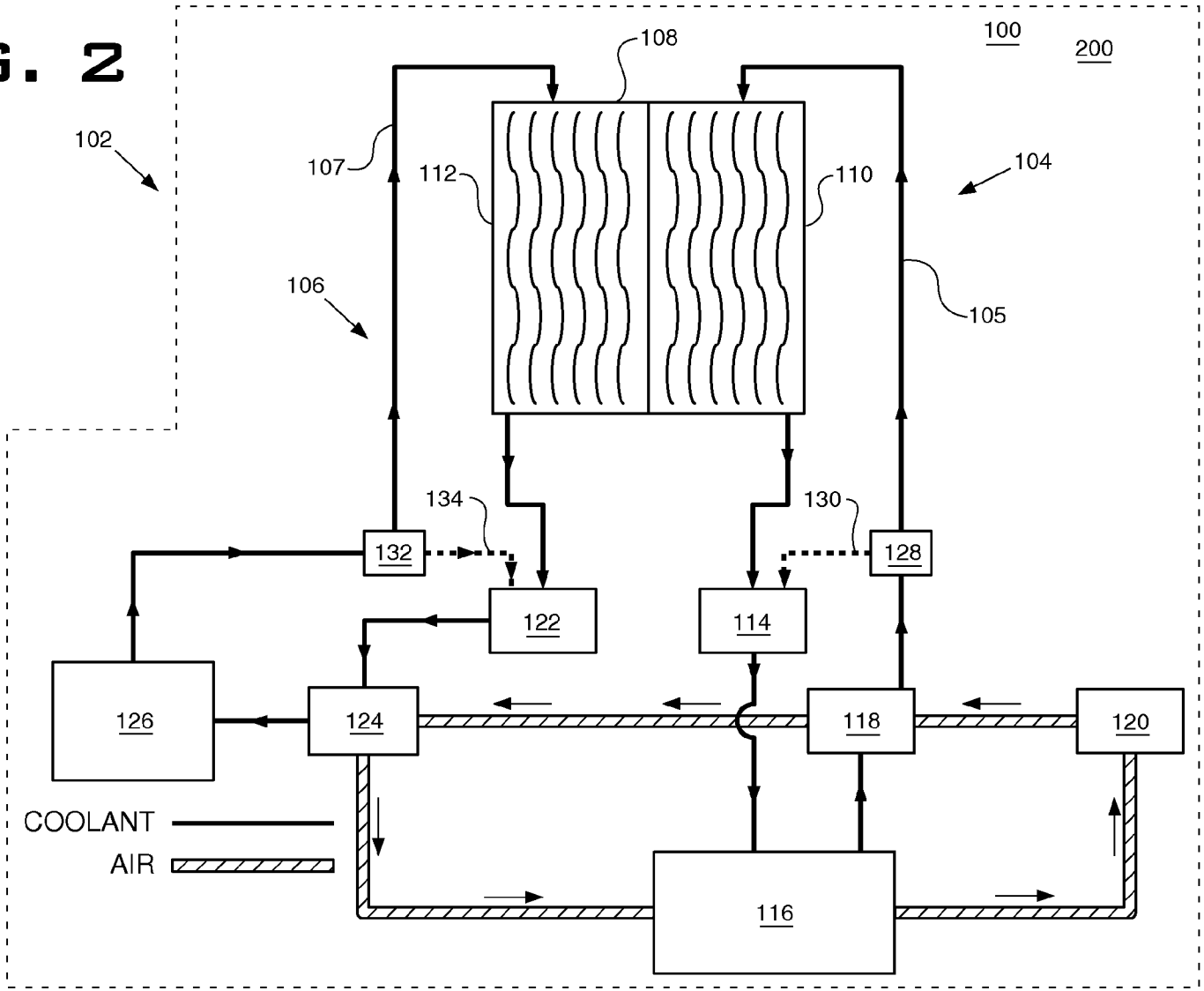
FIG. 2 illustrates an engine cooling system according to another embodiment of the present disclosure that includes two water pumps.

Referring now more specifically to FIG. 2, an internal combustion engine cooling system 100 is shown, for and as part of an engine 102. The cooling system 100 includes a first cooling circuit 104 and a second cooling circuit 106. Common to the first cooling circuit 104 and the second cooling circuit 106 is a radiator assembly 108 that includes a first heat exchanger 110 and a second heat exchanger 112. As shown in FIG. 2, the first cooling circuit 104 utilizes the first heat exchanger 110, whereas the second cooling circuit 106 utilizes the second heat exchanger 112.

The first cooling circuit 104 further includes a first water pump 114, such as for example, a jacket water pump, the radiator assembly 108 and more specifically the first heat exchanger 110, the engine head and block 116, and a first cooling unit 118. Accordingly, the first heat exchanger 110 provides heat exchange for the first cooling circuit 104, configured to reduce the temperature of a first cooling fluid 105 after it has been circulated through one or more cooling conduits embedded in the engine head and block 116 and the first cooling unit 118. The first cooling circuit 104 therefore provides cooling for the engine head and block 116 and a first-stage cooling of compressed or charge air directed from one or turbochargers (or the turbocharger system) 120 to and through the first cooling unit 118.

The second cooling circuit 106 further includes a second water pump 122, the radiator assembly 108 and more specifically the second heat exchanger 112, a second cooling unit 124, and one or more other cooling components 126. The one or more other engine cooling components may include an engine oil cooler, a transmission oil cooler, a hydraulic oil cooler, a brake oil cooler, as well as various cooling fluid conduits and valves and sensors (not shown) known in the art. Accordingly, the second heat exchanger 112 provides heat exchange for the second cooling circuit 106, configured to reduce the temperature of a first cooling fluid 107 after it has been circulated through the second cooling unit 124 and one or more other cooling components 126. The second cooling circuit 106 therefore provides cooling for one or more other engine components and a second-stage cooling of the compressed air flowing directed from the first cooling unit 118 to and through the second cooling unit 124.

As illustrated in FIG. 2, the first cooling circuit 104 includes a first temperature sensor and control 128 operably linked to a first bypass conduit 130. Similarly, the second cooling circuit 106 includes a second temperature sensor and control 132 operably linked to a second bypass conduit 134. The first temperature sensor and control 128 measures the temperature of the cooling fluid flowing from the first cooling unit 118, and, when the measured temperature is below a first pre-determined threshold temperature, directs the cooling fluid flow through the first bypass conduit 130 to the first water pump 114, thereby bypassing the radiator assembly 108. The second temperature sensor and control 132 measures the temperature of the cooling fluid flowing from the one or more other cooling components 126, and, when the measured temperature is below a second pre-determined threshold temperature, directs the cooling fluid flow through the bypass conduit 134 to the second water pump 122, thereby bypassing the radiator assembly 108.

Figure 3:
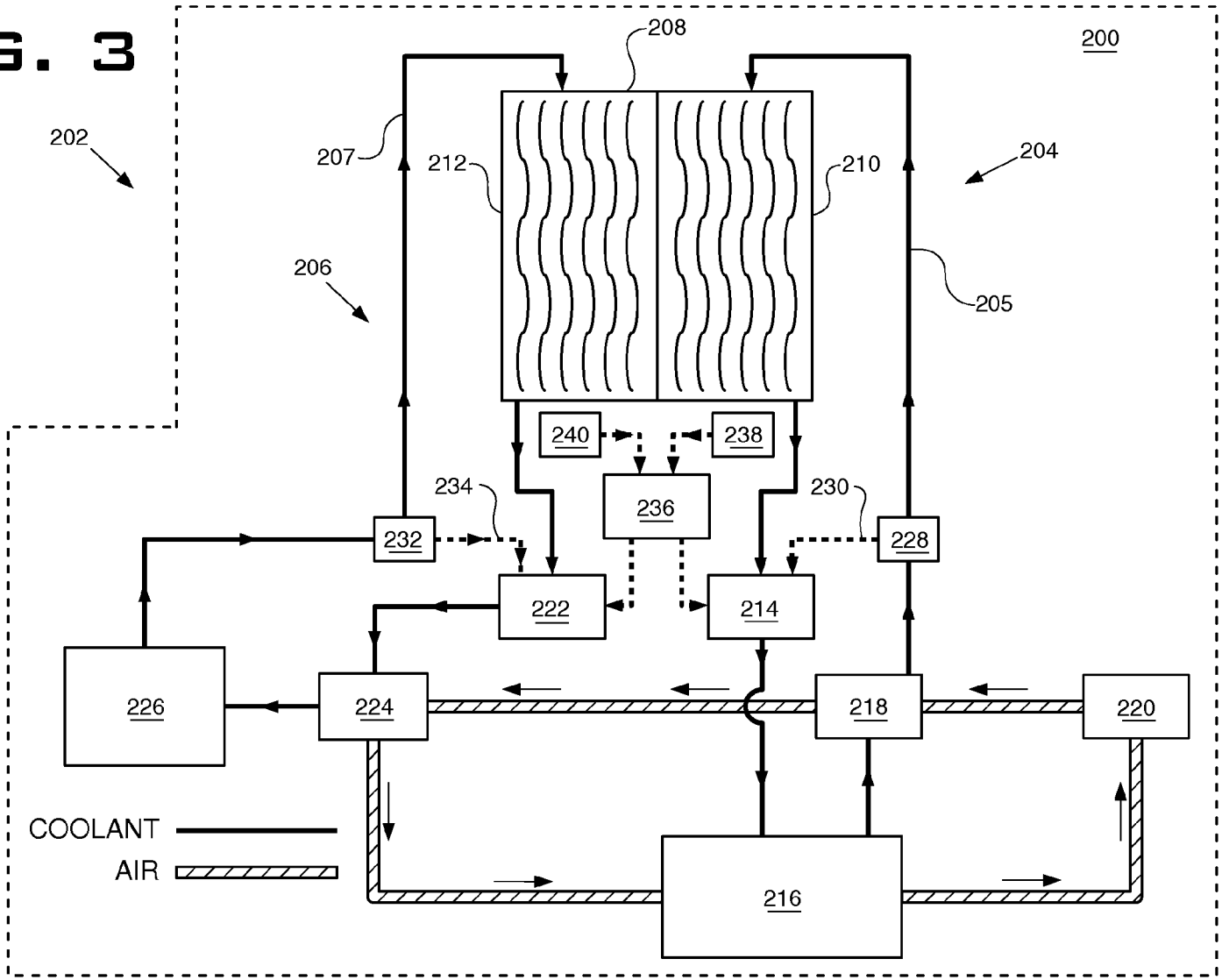
FIG. 3 illustrates an engine cooling system according to another embodiment of the present disclosure that includes two water pumps and a heat exchanger between the two cooling circuits.

FIG. 3 shows an internal combustion engine cooling system 200 that is identical to the cooling system 100 as shown in FIG. 2, except that the cooling system 200 further includes a third heat exchanger 236 and its operably linked temperature sensor and controls (238, 240). Same as the cooling system 100, the cooling system 200 includes a first cooling circuit 204 and the second cooling circuit 206. Common to the first cooling circuit 204 and the second cooling circuit 206 are a radiator assembly 208 and the third heat exchanger 236. The first cooling circuit 204 further includes a first water pump 214, whereas the second cooling circuit further includes a separate, second water pump 222.

As illustrated in FIG. 3, the temperature sensor and control 238 and the temperature sensor and control 240 measure the temperature of the first and second cooling fluids (205, 207) flowing from, respectively, the first heat exchanger 210 and the second heat exchanger 212. When the temperature sensor and control 238 detects a temperature of the first cooling fluid 205 flowing out of the first heat exchanger 210 higher than a first heat exchange threshold temperature, or the temperature sensor and control 240 detects a temperature of the second cooling fluid 207 flowing out the second heat exchanger 212 lower than a second heat exchange threshold temperature, or both, they will direct all or a portion of the respective cooling fluids to flow through the third heat exchanger 236 and then to the respective water pumps (214, 222), thereby allowing for the transfer of heat from the first cooling fluid 205 of the first cooling circuit 204 to the second cooling fluid 207 of the second cooling circuit 206.

In certain embodiments, the second cooling circuit 206 may operate at a higher temperature than the first cooling circuit 204. For example, during a retarding cycle in off-highway truck applications, a brake oil cooler in the one or more other cooling components 226 can be overheating, resulting in the second cooling circuit 206 operating at a higher temperature than that for the first cooling circuit 204. Under this circumstance, when the temperature sensor and control 238 detects a temperature of the first cooling fluid 205 flowing out of the first heat exchanger 210 lower than a third heat exchange threshold temperature, or the temperature sensor and control 240 detects a temperature of the second cooling fluid 207 flowing out the second heat exchanger 212 higher than a fourth heat exchange threshold temperature, or both, they will direct all or a portion of the respective cooling fluids to flow through the third heat exchanger 236 and then to the respective water pumps (214, 222), thereby allowing for the transfer of heat from the second cooling fluid 207 of the second cooling circuit 206 to the first cooling fluid 205 of the first cooling circuit 204.

An engine described herein, such as for example, the engine 12 as shown in FIG. 1, typically includes an engine head and block having one or more cooling fluid channels or conduits embedded therein, with a cooling fluid inlet and one or more cooling fluid outlets. The engine head and block further defines one or more combustion cylinders in which fuel and air are combusted, and the engine typically further includes pistons, valves, manifolds and the like.

A cooling unit as used herein may also be termed an aftercooler, such as the aftercooler described in U.S. Pat. No. 6,609,484, the content of which is incorporated by reference herein in its entirety. The cooling unit may be a jacket water cooler configured to facilitate the transfer of heat to or from the air that flows through the cooler. The aftercooler may include a tube and shell type heat exchanger, a plate type heat exchanger, or any other type of heat exchanger known in the art that can facilitate the transfer of heat to or from the air flowing through the aftercooler.

INDUSTRIAL APPLICABILITY

During use of an engine cooling system as described herein, the engine is operated in a known manner, with the resultant and inevitable generation of heat. The engine may further operate one or more turbochargers, to compress charge air which is then passed through the aftercooling system, such as for example, the system including the two aftercoolers (or cooling units) as described herein, for cooling thereof. A radiator assembly with at least two groups of radiator cores provides cooling by circulating a cooling fluid through both the first cooling circuit and the second cooling circuit as described herein, to cool engine, as well as the compressed or charge air.

According to one embodiment as illustrated in FIG. 1, the first cooling fluid 15 flows through the first heat exchanger 19 to the water pump 18. A portion of the first cooling fluid 15, of the first cooling circuit 14, is directed by the water pump 18 to the engine head and block 22 through the channels or conduits (not shown) therein, thereby cooling those engine components. The first cooling fluid 15 continues to flow into the first cooling unit 24, thereby providing the first-stage cooling of charge air compressed by the turbocharger system 26 operated by the engine 12. The first cooling fluid 15 may then return to the first heat exchanger 19, thus allowing heat to dissipate from the first cooling fluid 15 and be absorbed by the first heat exchanger 19.

The temperature sensor and control 32 measures the temperature of the cooling fluid flowing out of the first cooling unit 24, and when the measured temperature is below a first pre-determined threshold temperature, will operate to direct the first cooling fluid 15 to the water pump 18 through the bypass conduit 34, thereby bypassing the radiator assembly 20 (or more specifically the first heat exchanger or the first heat exchanger 19). When the measured temperature of the first cooling fluid 15 flowing out the first cooling unit 24 is above the first pre-determined threshold temperature, the temperature sensor and control 32 will operate to direct the cooling fluid into the radiator assembly 20, and more specifically, the first heat exchanger 19, thereby allowing heat to dissipate from the first cooling fluid 15.

The water pump 18 may also direct flow of another portion of the cooling fluid, the second cooling fluid 17 for the second cooling circuit 16, to the radiator assembly 20, and more specifically, the second heat exchanger 21, for further cooling thereof. The second cooling fluid 17 then flows from the second heat exchanger 21 into the second cooling unit 28, providing the second-stage cooling of the compressed or charge air cooled by and flowing from the first cooling unit 24. The compressed or charge air, after the two-stage cooling by the first and second cooling units 24 and 28, then flows into the engine air intake system or intake manifold (not shown) as typically controlled by the intake valves (not shown).

The second cooling fluid 17 subsequently flows from the second cooling unit 28 into one or more other cooling components 30, such as for example, a transmission oil cooler, a brake oil cooler, a hydraulic oil cooler, and a lube oil cooler. The second cooling fluid 17 then flows back into the water pump 18. Accordingly, the first cooling fluid 15 and the second cooling fluid 17 intersect at the water pump 18, which, depending on the water pump design, may allow heat exchange between the two cooling fluids (and therefore the two cooling circuits).

According to another embodiment as illustrated in FIG. 2, the first water pump 114 directs the first cooling fluid 105 from the first heat exchanger 110 to the engine head and block 116 through the channels or conduits (not shown) therein, thereby cooling those engine components. The first cooling fluid 105 continues to flow into the first cooling unit 118, thereby providing the first-stage cooling of the charge air compressed by the turbocharger system 120 operated by the engine 102.

The first temperature sensor and control 128 measures the temperature of the first cooling fluid 105 flowing out of the first cooling unit 118, and when the measured temperature is below a first pre-determined threshold temperature, will operate to direct the cooling fluid flow to the first water pump 114 through the bypass conduit 130, thereby bypassing the first heat exchanger 110). When the measured temperature of the first cooling fluid 105 flowing out the first cooling unit 118 is above the first pre-determined threshold temperature, the first temperature sensor and control 128 will operate to direct the cooling fluid flow into the first heat exchanger 110, thereby allowing heat to dissipate from the first cooling fluid 105.

The second water pump 122 directs the second cooling fluid 107 of the second cooling circuit 106 from the second heat exchanger 112 into the second cooling unit 124, which provides the second-stage cooling of the compressed or charge air flowing from and cooled by the first cooling unit 118. The second cooling fluid 107 subsequently flows from the second cooling unit 124 into other cooling components 126, such as for example, a transmission oil cooler, an engine or lube oil cooler, a brake oil cooler, and a hydraulic oil cooler. After passing through these other cooling components 126, the temperature of the second cooling fluid 107 is measured by the second temperature sensor and control 132, and if the measured temperature is below a second pre-determined threshold temperature, the second temperature sensor and control 132 will operate to direct the cooling fluid flow through the bypass conduit 134 and into the second water pump 122, thereby bypass the second radiator assembly 112. When the measured temperature of the second cooling fluid 107 flowing out the other cooling components 126 is above the second pre-determined threshold temperature, the second temperature sensor and control 132 will operate to direct the cooling fluid flow into the second heat exchanger 112, thereby allowing heat to dissipate from the cooling fluid.

Yet another embodiment of the present disclosure is illustrated in FIG. 3. The cooling system 200 has essentially the same components and operates in essentially the same manner as the cooling system 100 as shown in FIG. 2, except that the cooling system 200 includes a third heat exchanger 236, allowing the transfer of heat from the first cooling circuit 204 to the second cooling circuit 206 as operated by the temperature sensors and controls 238 and 240 under certain conditions as described above.

An exemplary total heat load for an engine cooling system as described herein may be 325 or 323 kW, which excludes the heat generated by air conditioning systems. For the illustrated embodiments, the heat generated by various engine components to be dissipated and absorbed by a radiator assembly (including two heat exchangers) and the cooling of each component are shown in the following table. The simulation results as shown below are based on the assumption that ambient air temperature is at 25° C., and the cooling fluid and other fluids (e.g., engine lube oil, transmission oil, hydraulic oil) have the same ambient temperature of 43° C.

| Components of Cooling Circuit | Single Water Pump Embodiment (FIG. 1) Heat Dissipated and Relevant Temperatures | Two-Water Pump Embodiment (e.g., FIG. 2 and FIG. 3) Heat Dissipated and Cooling Fluid Temperatures |
|---|---|---|
| Engine Head and Block | 94 kW<br>Cooling fluid at the outlet: 101° C. | 94 kW<br>Cooling fluid at the outlet: 105° C. |
| First Cooling Unit | 102 kW<br>Charge air temperatures: Inlet: 270° C.; Outlet: 83° C. | 99 kW<br>Charge air temperatures: Inlet: 270° C.; Outlet: 87° C. |
| Second Cooling Unit | 8 kW | 12 kW |

-continued

| Components of Cooling Circuit | Single Water Pump Embodiment (FIG. 1) Heat Dissipated and Relevant Temperatures | Two-Water Pump Embodiment (e.g., FIG. 2 and FIG. 3) Heat Dissipated and Cooling Fluid Temperatures |
|---|---|---|
| | Charge air temperatures: Inlet: 83° C.; Outlet: 69° C. | Charge air temperatures: Inlet: 87° C.; Outlet: 66° C. |
| Transmission Oil Cooler | 40 kW Oil temperatures: Inlet: 104° C.; Outlet: 95° C. | 40 kW Oil temperatures: Inlet: 100° C.; Outlet: 91° C. |
| Hydraulic Oil Cooler | 40 kW Oil temperatures: Inlet: 114° C.; Outlet: 92° C. | 40 kW Oil temperatures: Inlet: 110.5° C.; Outlet: 88° C. |
| Lube Oil Cooler | 40 kW Oil temperatures: Inlet: 109° C.; Outlet: 100° C. | 40 kW Oil temperatures: Inlet: 104° C.; Outlet: 95.5° C. |
| Total Heat Generated | 323 kW | 325 kW |

| Components of Cooling Circuit | Single Water Pump Embodiment (FIG. 1) Heat Absorbed and Cooling Fluid Temperatures | Two-Water Pump Embodiment (e.g., FIG. 2 and FIG. 3) Heat Absorbed and Cooling Fluid Temperatures |
|---|---|---|
| First Heat Exchanger | 178 kW Inlet: 106° C.; Outlet: 97° C. | 193 kW Inlet: 110° C.; Outlet: 101° C. |
| Second Heat Exchanger | 145 kW Inlet: 96° C.; Outlet: 88° C. | 132 kW Inlet: 90° C.; Outlet: 85° C. |
| Total Heat to be Absorbed | 323 kW | 325 kW |

Accordingly, the illustrative embodiments include a liquid-cooled system, which may provide certain advantages. First, it may incur lower costs, because the multi-pass radiator assembly as shown is usually less expensive than the conventional ATAACs. Second, it provides good serviceability. Third, the first cooling circuit typically operates at a higher temperature than the second cooling circuit, as indicated by the tables above and generally understood, and by allowing heat exchange between the two circuits, the illustrative systems may have overall improved thermal efficiency and be used to reduce fan parasitics.

Other embodiments of the disclosure will be apparent to those skilled in the art from consideration of the specification and practice of the disclosure disclosed herein. It is intended that the specification and examples be considered as exemplary only, with a true scope of the disclosure being indicated by the following claims.

What is claimed is:

1. A cooling system for an internal combustion engine having one or more turbochargers, comprising:

a first cooling circuit having a first heat exchanger configured to reduce the temperature of a first cooling fluid flowing through one or more cooling conduits of an engine head and block;

a first cooling unit in fluid communication with the first heat exchanger, the first cooling unit being configured to receive the first cooling fluid from the one or more cooling conduits of the engine head and block to reduce the temperature of a charge air directed from the one or more turbochargers;

a second cooling circuit having a second heat exchanger configured to reduce the temperature of a second cooling fluid flowing through at least one of a plurality of cooling components; and a second cooling unit in fluid communication with the second heat exchanger, the second cooling unit being configured to reduce the temperature of the charge air directed from the first cooling unit to the second cooling unit.

2. The cooling system of claim 1, wherein the first cooling circuit operates at a higher temperature than the second cooling circuit.

3. The cooling system of claim 1, wherein the at leaset one of a plurality of cooling components are chosen from cooling components adapted to cool engine oil, transmission oil, hydraulic oil, and brake oil of the internal combustion engine.

4. The cooling system of claim 1, wherein the first and second cooling circuits are in partial fluid communication with each other.

5. The cooling system of claim 1, further including a water pump common to the first cooling circuit and the second cooling circuit, wherein the water pump is configured to circulate the first cooling fluid through the first cooling circuit and the second cooling fluid through the second cooling circuit.

6. The cooling system of claim 1, wherein the first cooling circuit includes a first water pump configured to circulate the first cooling fluid in the first cooling circuit, and the wherein the second cooling circuit includes a second water pump configured to circulate the second cooling fluid in the second cooling circuit.

7. The cooling system of claim 6 further including a third heat exchanger configured to transfer heat between the first cooling circuit and the second cooling circuit.

8. The cooling system of claim 7, wherein the third heat exchanger is operably linked to at least one temperature sensor and control.

9. The cooling system of claim 8, wherein the at least one temperature sensor and control is configured to respond to a measured temperature above a first heat exchange threshold temperature of the first cooling circuit and/or below a second heat exchange threshold temperature of the second cooling circuit so as to activate the third heat exchanger to transfer heat from the first cooling circuit to the second cooling circuit.

10. The cooling system of claim 8, wherein the at least one temperature sensor and control is configured to respond to a measured temperature below a third heat exchange threshold temperature of the first cooling circuit and/or above a forth heat exchange threshold temperature of the second cooling circuit so as to activate the third heat exchanger to transfer heat from the second cooling circuit to the first cooling circuit.

11. The cooling system of claim 1, wherein the first heat exchanger includes a first group of radiator cores of a multi-pass radiator assembly and the second heat exchanger includes a second group of radiator cores of the multi-pass radiator assembly.

12. An internal combustion engine having one or more turbochargers that comprises a cooling system including:

a first cooling circuit having a first heat exchanger configured to reduce the temperature of a first cooling fluid flowing through one or more cooling conduits of an engine head and block; and a first cooling unit in fluid communication with the first heat exchanger, the first cooling unit being configured to receive the first cooling fluid from the one or more cooling conduits of the engine head and block to reduce the temperature of a charge air directed from the one or more turbochargers;

a second cooling circuit having a second heat exchanger configured to reduce the temperature of a second cooling fluid flowing through at least one of a plurality of cooling components; and a second cooling unit in fluid communication with the second heat exchanger, the second cooling unit being configured to reduce the temperature of the charge air directed from the first cooling unit to the second cooling unit.

13. The internal combustion engine of claim 12, wherein the first and second cooling circuits are in partial cooling fluid communication with each other.

14. The internal combustion engine of claim 12, further including a water pump common to the first cooling circuit and the second cooling circuit, wherein the water pump is configured to circulate the first cooling fluid through the first cooling circuit and the second cooling fluid through the second cooling circuit.

15. The internal combustion engine of claim 12, wherein the first cooling circuit includes a first water pump configured to circulate the first cooling fluid in the first cooling circuit, and wherein the second cooling circuit includes a second water pump configured to circulate the second cooling fluid in the second cooling circuit.

16. The internal combustion engine of claim 12 further including a third heat exchanger configured to transfer heat between the first cooling circuit and the second cooling circuit.

17. A method for cooling a charge air in an internal combustion engine having one or more turbochargers comprising:

directing the charge air from the one or more turbochargers to a first cooling unit, wherein the first cooling unit receives a first cooling fluid flowing along a first cooling circuit through one or more cooling conduits of an engine head and block and reduces the temperature of the charge air;

directing the charge air from the first cooling unit to a second cooling unit, wherein the second cooling unit receives a second cooling fluid flowing along a second cooling circuit through at least one of a plurality of cooling components adapted to cool engine oil, transmission oil, hydraulic oil, and brake oil of the internal combustion engine;

and directing the charge air from the second cooling unit to an air intake system of the internal combustion engine.

* * * * *